United States Patent [19]

Olsen

[11] Patent Number: 4,457,093

[45] Date of Patent: Jul. 3, 1984

[54] REVOLVING FIREARMS

[76] Inventor: Charles R. Olsen, 307 Conestoga Way #37, Eagleville, Pa. 19408

[21] Appl. No.: 467,247

[22] Filed: Feb. 17, 1983

Related U.S. Application Data

[62] Division of Ser. No. 187,772, Sep. 16, 1980, Pat. No. 4,393,782.

[51] Int. Cl.[3] ..... F41C 1/00

[52] U.S. Cl. ..... 42/59

[58] Field of Search ..... 42/59, 77

[56] References Cited

U.S. PATENT DOCUMENTS

| | | | |
|---|---|---|---|
| 2,238,587 | 4/1941 | Gaidos | 42/59 |
| 2,329,273 | 9/1943 | Kelly | 42/59 |
| 2,976,638 | 3/1961 | Owens | 42/59 |
| 3,124,889 | 3/1964 | Hellstrom | 42/59 |

FOREIGN PATENT DOCUMENTS

| | | | |
|---|---|---|---|
| 316732 | 8/1929 | United Kingdom | 42/59 |

*Primary Examiner*—Charles T. Jordan

[57] ABSTRACT

This invention relates to a means for utilizing smaller-diameter bullets in larger-diameter cartridge cases, to achieve higher velocity without bottlenecking the cartridge case, and a firearm having a reduced bore adapted to that cartridge. Additionally, the invention provides a means of sealing the cylinder-to-barrel gap in revolvers, eliminating gas leakage at that point and thereby increasing muzzle velocity by eight to twenty percent.

This invention is applicable to current gun models and cartridge components with little modification.

3 Claims, 6 Drawing Figures

REVOLVING FIREARMS

PRIOR ART

This application is a division of Ser. No. 187,772 for "Revolving Firearms and Ammunitions Therefor", filed Sept. 16, 1980, now U.S. Pat. No. 4,393,782.

It is well known that the muzzle velocity and energy of a bullet are directly related to the powder charge which projects the bullet. It is common practice to increase the case diameter, relative to the bullet, producing a cartridge having a bottleneck configuration. Bottleneck cartridges are common in rifles as well as automatic and single-shot pistols.

The bottleneck form is not suitable for use in revolving cylinder firearms as the case sets back against the frame, preventing the subsequent rotation of the cylinder, a condition known as cylinder freezeup.

Firing a bottleneck cartridge creates an elongation of the case between the chamber shoulder and the breech face. This elongation forces the breech face and the shoulder apart, eliminating headspace, and the free play in the breeching system, as well as deflecting the frame holding the breech face and chamber together. This deflection is maximum in open-frame construction such as a revolver and minimum in bolt action mechanisms.

The case elongation and frame deflection remain after firing, causing a binding force resisting breech operation.

In a bolt action, the first motion cams the bolt face away from the chamber shoulder, releasing the deflecting force. In a revolver, however, the first motion requires that the cartridge head slide across the breech face while under the full compressive force of the deflected action and elongated bottleneck case.

The only two modern bottleneck commercial cartridges developed for use in revolvers, the .22 Remington Jet and the .256 Winchester, have proven unsuccessful in revolvers due to case setback freezing the cylinder. No revolver is currently made for either cartridge.

The use of high-pressure bottleneck cartridges in revolving-cylinder firearms also causes severe gas loss and erosive gas cutting at the cylinder-to-barrel gap. The erosive gas cutting can be severe enough to change the dimensions of the parts and even cut sufficient metal from the lower face of the top strap to dangerously weaken the gun.

Various methods of preventing this gas loss have been tried. One method uses an expensive long case extending to the mouth of the cylinder and arranged so that the case will be elongated upon firing, thereby extending across the cylinder-to-barrel gap, to prevent gas loss at that point. Such a system is shown in U.S. Pat. No. 2,938,458 granted to John F. O'Brien. One embodiment of that invention has a metal-lined plastic sleeve within the elongated neck of the special cartridge case, forwardly slideable for engagement with the barrel.

While these devices can seal the cylinder-to-barrel gap, they remain in the elongated condition, bearing heavily against the barrel and breech faces and can only be used in motor or gas operated machine guns where there is adequate power to force the cylinder rotation in spite of the drag imposed at both ends of the cartridge case. In hand-operated revolving pistols, these systems result in total cylinder freezeup at both ends of the cylinder.

In addition to the freezeup problem encountered with bottleneck cases in revolvers, the bottleneck case manufacturing process is more costly than manufacturing a straight case due to the additional forming and annealing operations required. For example, a bottleneck .256 Winchester case costs at wholesale 5.1 cents more than the straight .357 Magnum case from which it is formed, a cost increase of approximately 35%.

An additional source of gas leakage occurs in conventional jacketed-bullet pistol cartridges. When the case expands diametrically upon firing, the jacketed bullet does not expand and gas passes between the bullet and the expanded case, bypassing the bullet and exiting the muzzle ahead of the bullet. Additionally, the gas escapes through the cylinder-to-barrel gap and around the cartridge case to the rear of the action.

OBJECTS OF THE INVENTION

It is an object of my invention to provide a means whereby a straight large-capacity cartridge case may be utilized with a smaller-diameter bullet without bottlenecking the case.

Another object of my invention is to obturate the cylinder-to-barrel gap, thereby preventing gas loss and gas cutting of the gun.

A further object of my invention is to provide an obturating means whereby gas will not bypass the bullet, escaping ahead of the bullet, rearwardly around the exterior of the cartridge case or out of the cylinder-to-barrel gap.

A still further object of my invention is to eliminate cylinder freezeup in revolvers by providing a slideable telescoping obturating adapter-member which will slide inwardly after firing so as to remove any residual force against the barrel face and against the breech face.

An additional object of my invention is to provide a chamber form which will not accept commercial cartridges based upon the same case and having large-diameter bullets.

SUMMARY OF THE INVENTION

In accordance with the device of the present invention, the above and other disadvantages of the prior art are overcome by providing a slideable tubular adapter-member holding the smaller-diameter bullet coaxially within the mouth of the larger-diameter straight cartridge case, without bottlenecking the cartridge case.

The cartridge is used with a revolver chambered for the large-diameter cartridge case and fitted with a barrel having a reduced bore which is of the caliber of the smaller-diameter bullet.

The cartridge case, bullet and gun components may be off-the-shelf items of many manufacturers; only the tubular adapter-member is a new item. The adapter-member may be a molded plastic part. The material known by the trademark LEXAN, made by the General Electric Corp., has proven highly satisfactory. No metal liner or reinforcement is needed.

In order to prevent the accidental insertion of a full-caliber round into the revolver of the present invention, an inhibiting chamber is described, having a small reduction in diameter at the forward end of the chamber. This undersize inhibiting band in the chamber prevents a full-caliber round from being fully inserted or fired. This inhibiting chamber requires only a modified chambering reamer to manufacture, as the cylinder may be conventional in all other respects.

The cartridge comprises a generally cylindrical adapter-member having an external diameter which fits within the mouth of the cartridge case and extends to the mouth of the revolver cylinder and holds a smaller-diameter bullet securely within a coaxial bore; the adapter with the bullet installed, is securely crimped into the cartridge case, producing a sealed round suitable for use in a revolver chamber.

The revolver of this invention may be conventional in all respects except that the bore is reduced relative to the chamber size so as to fire small-diameter bullets from larger-diameter cartridge cases. For example, a revolver of this invention may be made by fitting a .22 caliber barrel to a standard .357 Magnum revolver without changing any other parts. Similarly, a .357 barrel can be fitted to a .44 Magnum or a .45 Long Colt revolver.

When the revolver is fired, the adapter and bullet move forward approximately 0.01 inch whereupon the adapter strikes the rear face of the barrel stopping and sealing the cylinder-to-barrel gap, while the smaller-diameter bullet continues through the bore and exits the muzzle.

After the bullet exits the muzzle, pressure drops in the chamber allowing the adapter to telescope within the expanded case permitting free rotation of the cylinder.

The adapter-member remains with the cartridge case, retained in the expanded case by the residual crimp, and is extracted with the case. Both the adapter and the case may be reused.

The adapter, being of a resilient material and having a chambered seal at its rear face, swells upon firing, preventing the escape of gas between the expanded cartridge case and the carrier. After firing, the adapter resumes its initial size and fits slideably in the expanded cartridge case.

Since the adapter seal prevents leakage of gas at the cylinder-to-barrel gap, no gas cutting can occur and carbon particle buildup does not occur on the barrel or cylinder faces where it often binds conventional revolvers.

Since carbon particle buildup does not occur, the cylinder-to-barrel gap does not have to be carefully controlled. Larger-than-usual gaps are sealed by the adapter and smaller-than-usual gaps remain clean and do not bind the cylinder.

The protection provided by the adapter permits sharp, pointed bullets with fully exposed lead tips to be used without tip damage from handling.

Although many cartridge cases may be used with this system, three of the most suitable are the .357 Magnum, the .44 Magnum and the .45 Long Colt, being high-capacity cases suitable for heavy loads.

The .357 Magnum case is suited to medium-frame and heavy-frame revolvers while the .44 Magnum and .45 Long Colt cases require heavy-frame revolvers. The .357 Magnum, .44 Magnum and the .45 Long Colt cases may all be used with smaller-diameter bullets, and when used with those smaller-diameter bullets are referred to herein as the .224/357 Invicta, the .257/357 Invicta, the .358/.44 Invicta and the .358/.45 Invicta. The first number referring to the bullet diameter and the number after the stroke referring to the basic case. Other case and bullet combinations may, of course, be used.

All of these cartridges seal the cylinder-to-barrel gap effectively, as can be demonstrated by wrapping duct tape around the gap area. With the INVICTA cartridges the tape is unmarked, while conventional revolvers such as the .38 Special will shred and blacken the tape while throwing the pieces many feet.

In addition to the increased efficiency resulting from the sealing of the cylinder-to-barrel gap, the INVICTA cartridges have a larger powder capacity than bottleneck or conventional straight case cartridges on the same basic case as a result of positioning the shorter small-diameter bullet at the forward edge of the cylinder.

The forward location of the bullet reduces the bullet jump before engaging the rifling, resulting in improved accuracy as well as providing a substantial increase in powder capacity. Further, the adapter, being a close fit within the chamber, is capable of holding the bullet coaxial with the barrel better than the looser fitting conventional cartridge due to the closer concentricity tolerance which can be held on an injection-molded part than on a deep-drawn cartridge case.

The invention is particularly advantageous when the revolver is fitted with a silencer for use in covert military applications or tunnel clearing since all gas must escape through the silencer. This eliminates the escape of gas rearwardly around the case which in a conventional single-shot weapon can amount to 112 DB. In the silenced mode, the effectiveness can be further enhanced by using two bullets in tandem. Since the velocity must remain subsonic the gun is capable of firing two 110 grain .358 inch diameter bullets in tandem at 1000 fps. The use of two bullets in tandem requires only that the adapter-member be elongated sufficiently to hold both bullets.

The following table compares the case powder capacity in cubic inches, the velocity in feet per second and energy in foot-pounds of the INVICTA cartridges with other commercial cartridges when fired in revolvers.

| CARTRIDGE NAME | CASE CAPACITY CU. IN. | BULLET WEIGHT GRAINS | BARREL LENGTH INCHES | MUZZLE VELOCITY FT./SEC. | MUZZLE ENERGY FT. LB. |
|---|---|---|---|---|---|
| .22 REM. JET | .0676 | 40 | 8.375 | 1860[p] | 307 |
| .224/.357 INVICTA | .0956 | 40 | 10.63 | 2950[c] | 773 |
| .257/.357 INVICTA | .0853 | 60 | 12.00 | 2300[c] | 705 |
| .357 MAGNUM | .0636 | 125 | 8.5 | 1591[p] | 703 |
| .358/.44 INVICTA | .1323 | 125 | 12.00 | 2306[c] | 1476 |
| .44 REM | .0948 | 240 | 8.00 | 1386[p] | 1024 |

-continued

| CARTRIDGE NAME | CASE CAPACITY CU. IN. | BULLET WEIGHT GRAINS | BARREL LENGTH INCHES | MUZZLE VELOCITY FT./SEC. | MUZZLE ENERGY FT. LB. |
|---|---|---|---|---|---|
| MAGNUM | | | | | |

[P]Published data
[C]Chronographed data

BRIEF DESCRIPTION OF THE DRAWINGS

Referring now to FIG. 1, the revolver frame 11 is shown fixed to the barrel 12 and holding the cylinder 13 so that it may be rotationally indexed to align sequential chambers with the barrel 12 and the firing pin hole 14.

Figure 1:
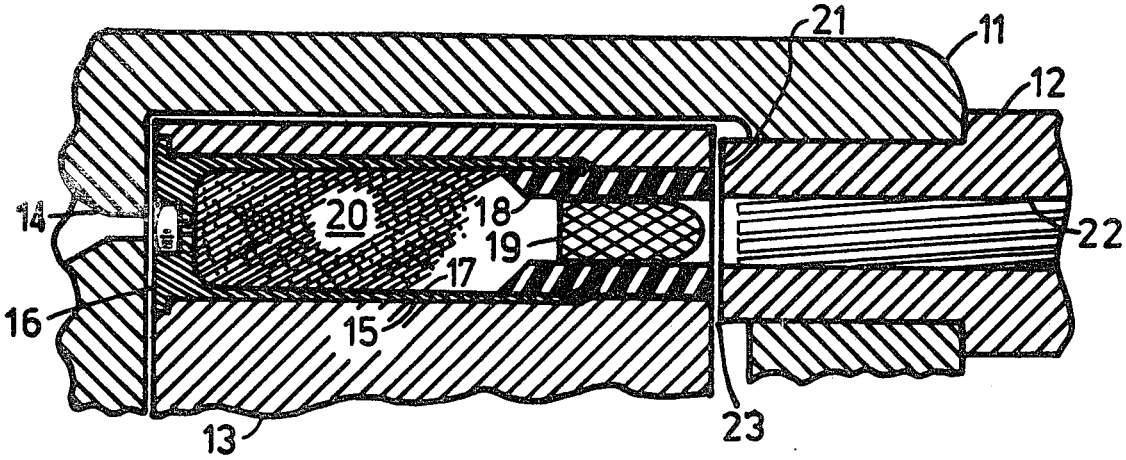
FIG. 1 shows a longitudinal sectional view of the chamber portion of a revolver and a cartridge of one embodiment of the present invention.

A chamber 15 is shown holding a cartridge 16, which is one embodiment of the present invention. In the example illustrated, a .357 Magnum cartridge case 17 holds an adapter-member 18 which is axially bored to hold a .22 caliber bullet 19.

When the cartridge 16 is fired, the propellant 20 burns, and the expanding gas drives the adapter 18 and bullet 19 forward. The adapter-member 18 is stopped by striking the rear face 21 of the barrel 12, while the bullet 19 passes through the adapter 18 and the bore 22 of the barrel 12.

While the bullet 19 is in the bore 22, gas pressure in the cartridge case holds the adapter-member 18 against the rear face 21 of the barrel 12, sealing the cylinder-to-barrel gap 23, preventing the escape of propellant gas.

When the bullet 19 exits the muzzle of the barrel 12, the gas pressure drops to ambient, removing the force on the adapter-member 18, freeing the adapter-member to retract into the cartridge case 17 which has been slightly expanded by firing and permits the adapter-member 18 to slide within the limits of the residual crimp remaining.

When the adapter-member 18 can retract into the case 17, there is no longer any force holding the head of the case 17 against the breech face of the frame or any force holding the adapter 18 against the rear face 21 of the barrel 12. The cylinder 13 is then free to index without any drag at either end.

Figure 2:
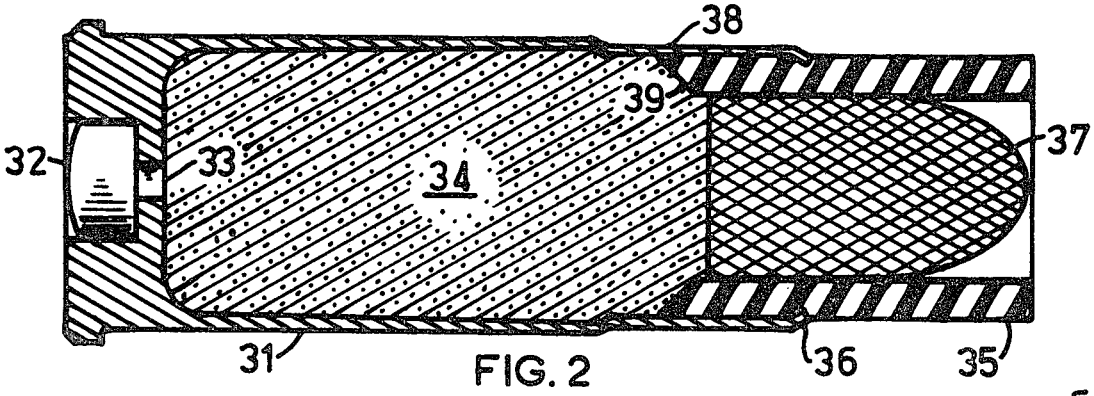
FIG. 2 shows a longitudinal sectional view of the cartridge of a different embodiment of the present invention.

Referring now to FIG. 2, another embodiment of the invention is shown. A .44 Remington Magnum cartridge case 31 is shown, having a primer 32, and a vent 33 communicating between the primer 32 and the propellant 34. An adapter-member 35 is crimped into the case mouth at 36 and contains a bullet 37, which in the illustrated example is a .258 caliber bullet.

Figure 3:
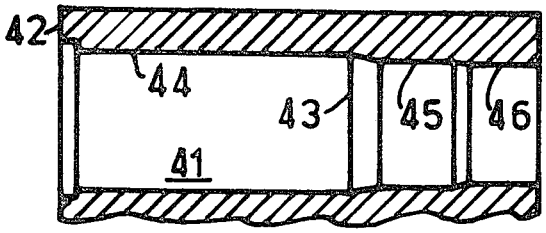
FIG. 3 shows a longitudinal sectional view of an inhibiting chamber of the present invention which will accept the cartridge of FIG. 2 but will not accept the larger-diameter commercial cartridges which use the same basic case with larger bullets.

A portion of the case extending from the mouth at least 0.10 inch toward the head is of reduced diameter, as indicated at 38, so as to fit within the inhibiting chamber shown in FIG. 3.

The rear face of the adapter-member 35 is shown countersunk at 39 to provide a tapered lip seal which will expand against the cartridge case 31 preventing gas escape around the adapter upon firing.

FIG. 3 shows an inhibiting chamber 41 in a portion of a revolver cylinder 42. The portion of the chamber to the left of the line 43 is in accordance with industry standards for the basic case used, in this example a .44 Magnum.

The length of the standard chamber portion 44 is made less than the length of the shortest commercial cartridge case which might be inadvertently inserted in the chamber. The chamber portions 45 and 46 are of smaller diameter for those standard commercial cartridges by at least 0.005 inch. The inhibiting band 45 prevents the full insertion of any .44 Magnum, .44 Special or .44 S & W American cartridge into the revolver, thereby preventing any accidental firing of those cartridges through a smaller-diameter bore which would create excessive pressures.

A similar chamber for the .357 Magnum basic case would similarly inhibit the introduction of a .257 Magnum, .38 Special or .38 Long Colt cartridge. A chamber for the .45 Long Colt basic case needs to inhibit only the .45 Long Colt cartridge.

The chamber throat portion 46 is also reduced in diameter by the same amount as is the inhibiting band 45 reduced so that the adapter may be cylindrical and close fitting in both the mouth of the cartridge case and the chamber throat 46.

Figure 4:
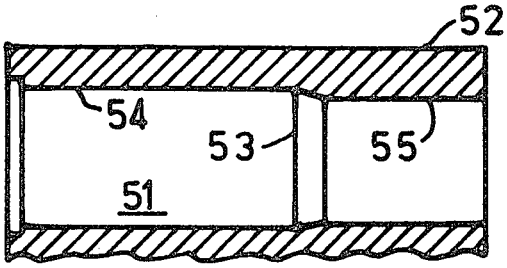
FIG. 4 shows a longitudinal sectional view of a different embodiment of an inhibiting chamber of the present invention, which permits the use of a thicker wall adapter-member.

FIG. 4 shows a different embodiment of an inhibiting chamber 51 in a portion of a revolver cylinder 52.

The portion of the chamber to the left of the line 53 is in accordance with industry standards for the basic case used, in this example a .44 Magnum. The length of the standard chamber portion 54 is too short to fully seat standard cartridges such as the .44 Magnum, .44 Special or .44 S & W American.

The inhibiting band 55 of this embodiment extends forward to the chamber mouth and provides at least 0.005 inch interference for the above commercial cartridges.

Figure 5:
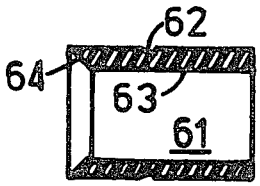
FIG. 5 shows a longitudinal sectional view of the cylindrical adapter of the type seen in FIGS. 1 and 2.

FIG. 5 shows the straight cylindrical adapter-member 61 as used with the inhibiting cylinder of FIG. 3. A crimping groove is seen at 62 in the outer cylindrical surface. The bore 63 may be cylindrical or have a slight taper or step so that the bullet which is pressed into the adapter bore 63 will not be dislodged toward the chamber mouth by recoil from rounds fired in adjacent chambers.

A countersink 64 in the left end of the adapter 61 forms a resilient lip seal against the cartridge case, preventing propellant gas escape between the adapter and the cartridge case wall.

The form of the countersink 64 is not critical; it may be conical as shown or may have a curved form.

Figure 6:
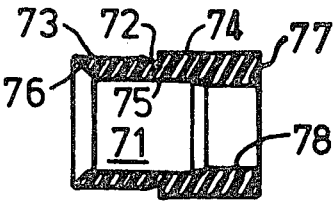
FIG. 6 shows a longitudinal sectional view of the "heel" type thicker-walled adapter-member which is used with the chamber shown in FIG. 4.

FIG. 6 shows the stepped cylindrical "heel" type adapter-member 71 which is used with the inhibiting chamber of FIG. 4. A crimping groove is seen at 72 separating the two outer cylindrical diameters, the "heel" portion 73 and the enlarged forward portion 74.

The "heel" portion 73 is made to fit within the inside diameter at the mouth of the cartridge case, while the forward portion 74 may be enlarged to match the outside diameter of the cartridge case mouth providing an adapter having a thicker wall face 77 which seals the cylinder-to-barrel gap.

The adapter-member bore 75 may be cylindrical or have a slight taper or step 78 so that the bullet will not be dislodged toward the chamber mouth by recoil from rounds fired in adjacent chambers.

A countersink 76 forms a resilient lip seal against the cartridge case, preventing propellant gas escape between the adapter and the cartridge case wall.

The enlarged sealing face 77 of this embodiment provides both a thicker adapter-member wall in the unsupported cylinder-to-barrel gap area 23 and a larger area of contact with the barrel face 21 reducing the load per unit area on the adapter-member 71.

I claim:

1. A revolver firearm of the type including a frame having a barrel secured thereto through which a fired bullet is ejected, and a revolvable cylinder positioned behind the barrel, which cylinder is provided with a plurality of cartridge receiving chambers successively alignable with the barrel as the cylinder is revolved, said revolver comprising in combination, (a) a barrel having an internal passage therethrough to permit the passage of a bullet of a first size, (b) a cylinder having inhibiting chambers which accept a special cartridge including a case of a size which in a standard cartridge normally contains a bullet of a second size larger than a bullet of said first size, said chambers being so configured that a standard cartridge using a standard case can not be fully inserted into the cylinder chamber to thereby prevent firing of standard cartridges having bullets which can not properly pass through the barrel.

2. A revolver as described in claim 1 wherein the length of the cylinder inhibiting chamber within which the cartridge case of the special cartridge is disposable is shorter than the length of the shortest comparably sized commercial cartridge case which could be attempted to be inserted into the chamber.

3. A revolver as described in claim 1 or 2 wherein the throat of the cylinder inhibiting chamber is of reduced diameter compared to the diameter of a comparably sized commercial cartridge which could be attempted to be inserted into the chamber.

* * * * *